US005794451A

United States Patent [19]

Lee et al.

[11] Patent Number: 5,794,451

[45] Date of Patent: Aug. 18, 1998

[54] METHOD FOR CONTROLLING AN ICE-EJECTING MODE OF AN ICE MAKER

[75] Inventors: Kun-bin Lee, Seoul; Sung-ho Cho, Kyonggi-do, both of Rep. of Korea

[73] Assignee: Samsung Electronics Co., Ltd., Suwon, Rep. of Korea

[21] Appl. No.: 872,064

[22] Filed: Jun. 10, 1997

[30] Foreign Application Priority Data

Jun. 10, 1996 [KR] Rep. of Korea ..... 96-20576

[51] Int. Cl.[6] ..... F25C 5/06

[52] U.S. Cl. ..... 62/71; 62/126; 62/233

[58] Field of Search ..... 62/72, 126, 130, 62/233, 353, 71

[56] References Cited

U.S. PATENT DOCUMENTS 4,424,683 1/1984 Manson ..... 62/233
5,163,300 11/1992 Kato et al. ..... 62/233
5,617,728 4/1997 Kim et al. ..... 62/71
5,675,975 10/1997 Lee ..... 62/72

*Primary Examiner*—William E. Tapolcai
*Attorney, Agent, or Firm*—Burns, Doane, Swecker & Mathis, L.L.P.

[57] ABSTRACT

An ice making mechanism includes a tray for receiving water to be frozen into ice bodies, a sensor for determining whether the water is frozen, to initiate an ice-ejecting mode, a motor for rotating the tray to perform the ice-ejecting mode, a switching mechanism for indicating a state of the ice-ejecting mode, and a switch actuating structure driven by the motor for changing a state of the switches during the ice-ejecting mode. When an ice-ejecting mode is initiated, a time period for the state of the switching mechanism to be changed is compared with a reference time period. If the state of the switching mechanism has not been changed within the referenced time period, the ice-ejecting mode is stopped, and the tray is returned to an up-right position. Also, an alarm signal is generated indicating to a user that the ice-ejecting mode has been stopped.

9 Claims, 5 Drawing Sheets

METHOD FOR CONTROLLING AN ICE-EJECTING MODE OF AN ICE MAKER

RELATED INVENTION

This invention is related to that disclosed in concurrently filed U.S. Ser. No. 08/872,395 (Attorney Docket No. 031946-001).

BACKGROUND OF THE INVENTION

1. Field of the Invention

This invention relates to a method for controlling the ice-ejecting mode of an automatic ice maker.

2. Description of the Related Art

Usually, an ice maker is disposed within a freezing chamber of a refrigerator. Such an ice maker includes a tray automatically supplied with water to be frozen to form ice bodies. The maker automatically checks the freezing condition of the water in the tray. Upon completion of freezing the ice bodies, the ice maker ejects the ice bodies from the tray to an ice collecting bin. Such convenience makes the ice maker a necessary component of a refrigerator.

The conventional ice maker operates with several function units, which are shown in FIG. 1. According to the drawing, there is a power supply 1 for supplying the ice maker with drive voltage. A first sensing means 2 is for sensing the position of the tray. A function selector 3 includes a plurality of function keys for allowing a user to choose an automatic ice-making function. A first rotation controller 5 controls the rotation of an ice-ejecting motor 4 which operates to eject ice bodies. A second rotation controller 7 controls rotation of a water supply motor 6 for supplying the tray with water. A second sensing means 8 mounted on the bottom of the tray checks the ice-ejecting status. A motor protector 9 prevents the motor 4 from overload. Finally, a microcomputer 10 governs all of the above components.

The structure of the ice maker is illustrated in FIG. 2A through FIG. 2C. Referring to FIG. 2A, the ice maker includes a housing 11. An ice-ejecting motor 4 and a worm gear 12 fixed on a shaft extending from the motor 4 are enclosed in the housing 11. Also enclosed are a first gear 13, a second gear 14 and a third gear 15 which are in mesh successively from the worm gear 12 to the third gear 15, whereby the rotary power of the worm gear 12 is transmitted to the third gear 15 successively. A cam gear 16 is meshed with the third gear 15 and rotated thereby.

A lug 18 is formed by a radial extension of the cam gear 16 at a fixed position of the circumference thereof and protects a tray 17 from excessive rotation beyond a normal upright state which may cause damage to the tray 17. In the housing is arranged a first stopper 19 to come in contact with the lug 18 to obstruct counter-clockwise rotation of the cam gear 16 when the tray 17 has returned to the horizontal upright state.

When the tray 17 rotates approximately 158° clockwise from the FIG. 2A position, the lug 18 comes in contact with a second stopper 20 fixed on the motor 4 to prevent the cam gear 16 from rotating further clockwise.

A horizontal switch 21 for showing the horizontal status of the tray 17 is furnished under the cam gear 16. The horizontal switch 21 is controlled by a horizontal adjusting cam 22 installed on the cam gear 16.

A level switch 23 is located adjacent to the horizontal switch 21. When an arm connector 25 is pushed by an arm adjusting cam 24 installed on the cam gear 16, a level arm 26 fixed to the arm connector 25 pivots to turn the level switch 23 on. At this time, the pivotal rotation of the level arm 26 is controlled by a quantity of the ice bodies in the ice collecting bin (not shown).

Referring to FIG. 2C, a sensor 27 (e.g. a thermistor) is mounted on the bottom of the tray 17. It senses the temperature of the tray 17 and determines the condition of the ice bodies in the tray 17, i.e. whether the ice bodies have become completely frozen or not, and whether the ice bodies have been removed from the tray 17. The sensor 27 is included in the second sensing means 8 of FIG. 1. According to the temperature change sensed by the sensor 27, the second sensing means 8 checks a change in voltage to determine the status of the ice bodies.

The operation of the conventional ice maker will be described with reference to FIG. 3A to FIG. 3D.

When a user selects a key out of the plurality of function keys of the function selector 3 for an automatic ice making process, the microcomputer 10 recognizes the manipulation. Simultaneously, voltage from the power supply 1 is provided to the microcomputer 10 and all the other components of FIG. 1.

The microcomputer 10 then receives control signals from the function selector 3 and outputs corresponding control signals. Afterwards, the control signals are transmitted to the second rotation controller 7 to activate the water supply motor 6. As a result, a preselected amount of water is supplied to the tray 17 via a delivery tube (not shown) from a suitable water source disposed in a fresh food chamber (not shown). At this time, the tray 17 is in the initial upright state as shown in FIG. 3A. The horizontal switch 21 is in contact with a recessed part of 22B of the horizontal adjusting cam 22. Therefore, the horizontal switch 21 maintains an off-state. The arm connector 25 is not pressed by the arm adjusting cam 24. Accordingly, the level arm 26 does not rotate. The level switch 23 also maintains an off-state. As described above, when both of the horizontal switch 21 and the level switch 23 are in an off-state, the microcomputer 10 determines that the tray 17 is in an initial state.

The microcomputer 10 checks a freezing condition of the water in the tray 17 by the second sensing means 8. Upon completion of freezing, the microcomputer 10 transmits a control signal to the first rotation controller 5 to rotate the motor 4 in a direction (e.g. clockwise direction as illustrated here). This is shown in FIG. 3B. The horizontal adjusting cam 22 accordingly rotates. After a few degrees of rotation, the horizontal switch 21 comes in contact with a round (non-recessed) part of the horizontal adjusting cam 22. As a result, the state of the horizontal switch 21 is converted into an on-state. Furthermore, the arm connector 25 is in contact with the round part of the arm adjusting cam 24. At this time, the arm connector is pressed and the level arm 26 rotates. Consequently, the level switch 23 is also converted into an on-state. When the horizontal switch 21 and the level switch 23 are in their on-state, the microcomputer 10 determines that the ice maker is in an ice-ejecting preparation state.

The horizontal adjusting cam 22 further rotates during the rotation of the motor 4. As a result, the horizontal switch 21 comes in contact with the other curved recessed part 22A of the horizontal adjusting cam 22. At this time, the horizontal switch 21 returns to an off-state. However, the arm connector 25 is still in contact with the round part of the arm adjusting cam 24. In other words, arm connector is still pressed by the round part of the cam 24 so that the level switch 23 maintains the on-state, which is shown in FIG. 3C. This state is indicated to the microcomputer 10. Then, the microcomputer 10 determines that the ice maker is in an ice-ejecting state, followed by controlling the first rotation controller 5 to suspend the operation of the motor 4. When the open side of the tray 17 faces the ice collecting bin before the rotation of the tray 17 has completely stopped, one end (i.e. the end opposite to the motor 4) of the rotating shaft installed at the bottom of the tray 17 is caught on a projection (not shown), while the other end (i.e. the end connected to the motor 4) of the rotating shaft continues to be rotated by the motor 4. Accordingly, the tray is twisted to eject the ice bodies.

The second sensing means 8 sends a control signal when it determines that the ice bodies have been completely ejected from the tray 17. As a result, the microcomputer 10 controls the first rotation controller 5 to make the motor 4 rotate in a counter-direction (counter-clockwise direction as illustrated here). Then, the horizontal switch 21 comes in contact with the round part of the horizontal adjusting cam 22 and is converted into an on-state. The arm connector is still in contact with the round part of the arm adjusting cam 24 so that the level switch 23 still maintains an on-state. At this time, the microcomputer 10 senses that both the horizontal switch 21 and the level switch 23 are in an on-state. Consequently it determines that the ice maker is in a return preparation state.

Afterwards, due to continuing rotation of the motor 4, the horizontal switch 21 comes in contact with the curved recessed part of the horizontal adjusting cam 22 and the arm connector 25 is released from the pressure of the arm adjusting cam 24 as shown in FIG. 3D. Thus, both the horizontal switch 21 and the level switch 23 are converted into an off-state. The microcomputer 10 senses that the horizontal switch 21 and the level switch 23 are turned off and determines that the ice maker has returned to the initial state. As a result, the microcomputer 10 controls the first rotation controller 5 in order to suspend the rotation of the motor 4. The suspension of the motor 4 represents the end of an automatic ice making cycle.

Such an ice making cycle includes several states, i.e. the initial state, the ice-ejecting preparation state, the ice-ejecting state, the return preparation state and the return state, which may be repeated as required.

The motor protector 9 detects voltage supplied to the motor 4. In order to protect the motor 4 from damage or troubles caused by overload, the rotation of the motor 4 stops in the presence of excessive voltage supply.

However, in the event the tray 17 is provided with excessive water, the weight of the water prohibits the ice maker from normal operation. Moreover, the over-supplied water becomes frozen into one ice body, not separated ice bodies, which also causes an abnormal operation of the ice maker. This results in an overload in the motor 4. When the motor 4 undergoes an overload, the motor protector 9 stops the motor 4. However, the user is unaware that a malfunction has occurred.

There is another problem. When the motor 4 is suddenly stopped by the motor protector 9, the tray 17 cannot return to the horizontal upright state. Under this condition, the ice maker cannot commence normal ice making process again.

There is still another way in which abnormal operation is caused by over-supplied water. When the over-supplied water is frozen, it is difficult to completely eject ice bodies from the tray 17, i.e., ice residue remains. The tray 17 with ice-residue returns to the initial state and is provided with the preselected amount of water from the water source. The presence of ice-residue makes the water overflow from the tray 17. As a result, the overflown water becomes frozen on the bottom of the freezing chamber as well as in the ice collecting bin.

SUMMARY OF THE INVENTION

Accordingly, an object of the present invention is to provide a method for controlling the ice-ejecting mode of an ice maker, which includes steps of: checking an ice-ejecting operation of an ice maker by detecting a time required to change states of the horizontal switch and the level switch; and returning the ice maker to an initial state by stopping and rotating a motor in counter-direction (counter-clockwise direction) when the ice maker does not normally perform an ice-ejecting operation.

Another object of the invention is to provide a method for controlling the ice-ejecting mode of the ice maker which includes a step of generating an alarm signal to allow users to easily recognize that the ice maker has stopped operating in the case it cannot proceed with a normal ice-ejecting operation.

The method uses an ice maker which ejects ice bodies after checking the freezing condition of water in a tray and controls ice-ejecting mode according to the position of the tray as determined by first and second switches, i.e., a horizontal switch and a level switch. The method comprises the steps of initiating an ice-ejecting mode, and counting a time period beginning from such initiation. The method further comprises determining whether the state of the switching mechanism has been changed, and stopping the ice-ejecting mode when a state of the switching mechanism has not changed within a referenced time period. The method also includes the step of generating an alarm signal indicating that the ice making mode has been stopped.

In addition to stopping the ice-ejecting mode, the tray is preferably returned to an initial upright state.

The generation of an alarm signal preferably comprises generating a visible alarm signal and/or an audible alarm signal.

The determining step preferably comprises sensing a change of state of the switching mechanism, determining the time period when such a change of state occurs, and comparing the time period with a reference time period.

The switching mechanism preferably comprises first and second separately actuable switches. The determining step preferably comprises determining a first time period beginning from the initiation of the ice-ejecting mode, when both switches are changed from an off-state of an inactive condition to an on-state of a final ice-ejecting preparation condition, and comparing the first time period with a first reference time period.

The determining step further comprises determining a second time period beginning from the initiation of the ice-ejecting mode, when the first switch is changed from the on-state of the final ice-ejecting preparation condition to an off-state of an ice-ejecting condition, and comparing the second time period with a second reference time period.

The determining step further comprises determining a third time period beginning from the initiation of the ice-ejecting mode, when the first switch is changed from the off-state of the inactive condition to an on-state of an initial ice-ejecting preparation state with the second state still in an off-state, and comparing the third time period with a third reference time period.

BRIEF DESCRIPTION OF THE DRAWINGS

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

The following is a preferred embodiment according to the invention. For description purposes, elements having basically the same function as the previously described conventional elements are identified using common reference numbers throughout the drawings, and detailed descriptions thereof are omitted below.

Figure 1:
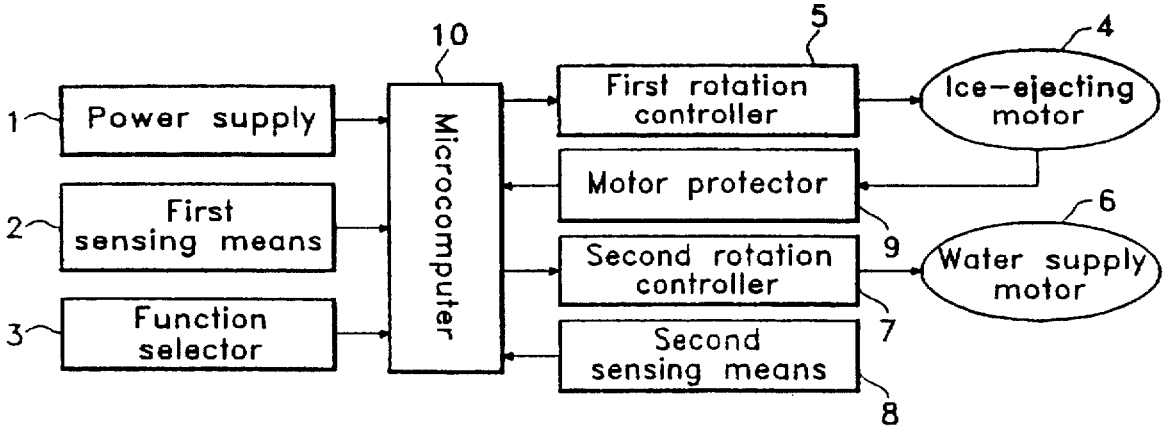
Fig. 1 (PRIOR ART)
FIG. 1 is a schematic block diagram of a conventional ice maker.
Figure 2A:
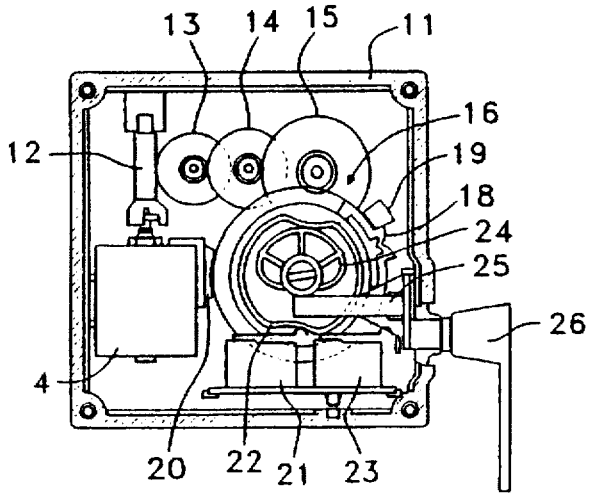
Fig. 2A (PRIOR ART)
FIG. 2A to FIG. 2C are perspective views of the conventional ice maker.
Figure 2B:
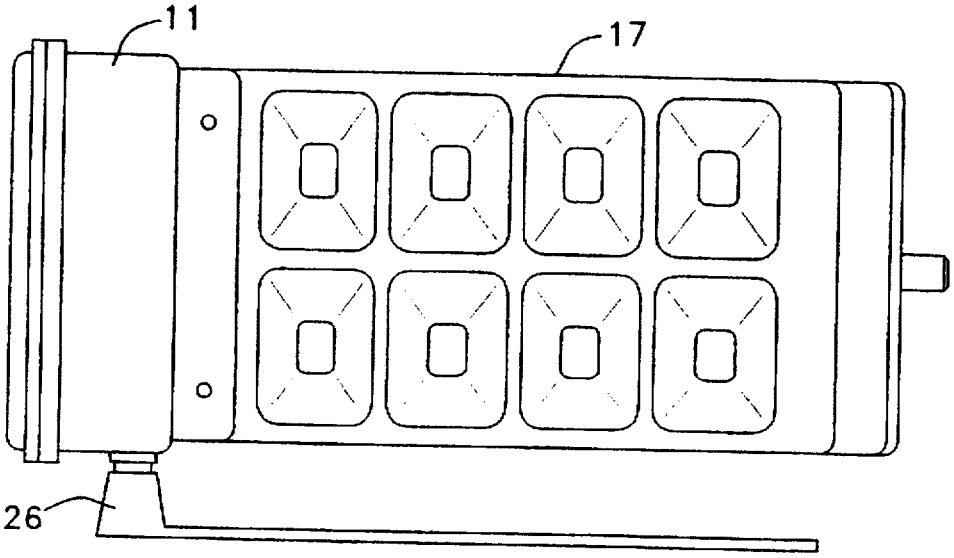
Fig. 2B (PRIOR ART)
Figure 2C:
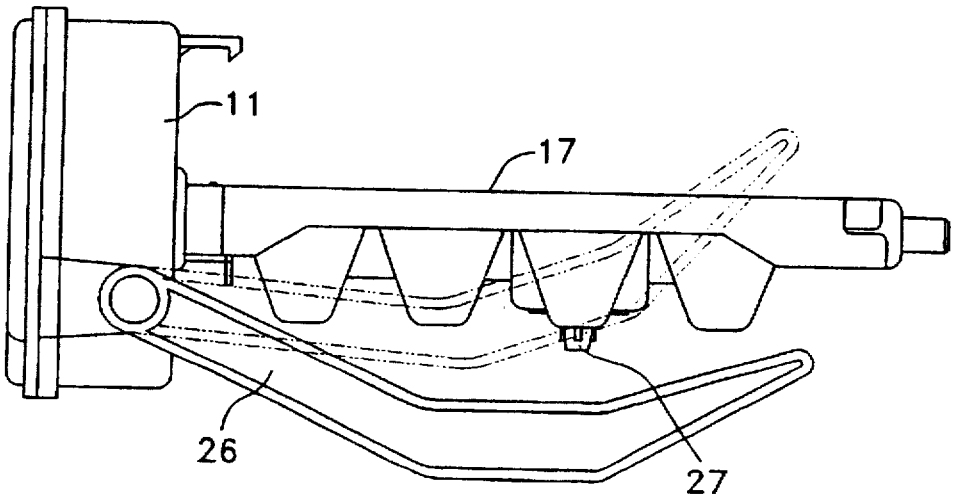
Fig. 2C (PRIOR ART)
Figure 3A:
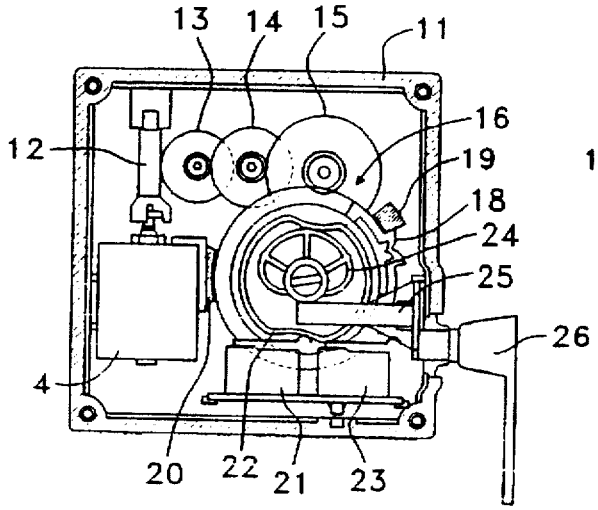
Fig. 3A (PRIOR ART)
FIG. 3A to 3D are perspective views for explaining the operation of the conventional ice maker.
Figure 3B:
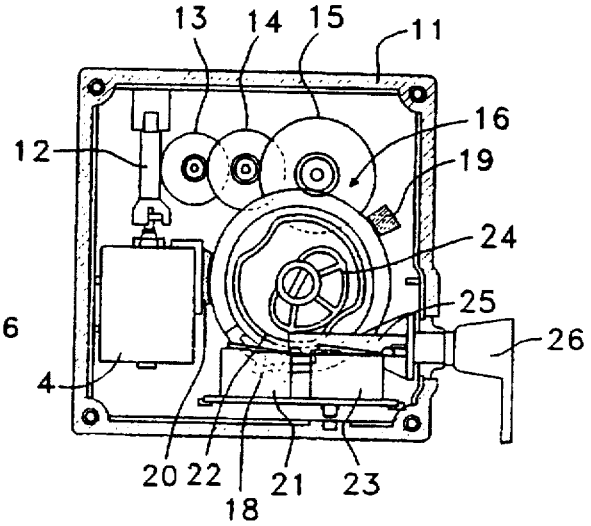
Fig. 3B (PRIOR ART)
Figure 3C:
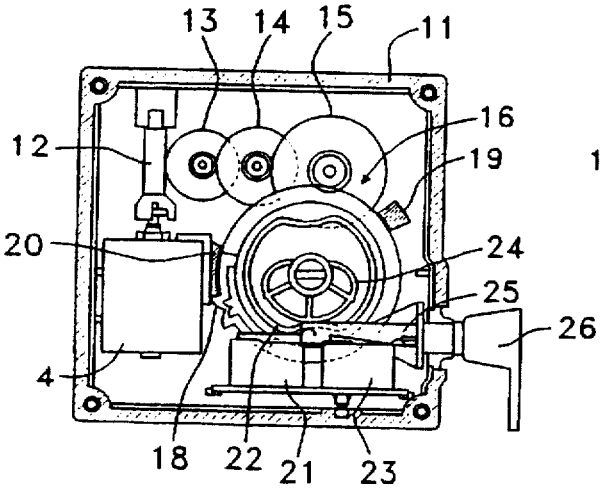
Fig. 3C (PRIOR ART)
Figure 3D:
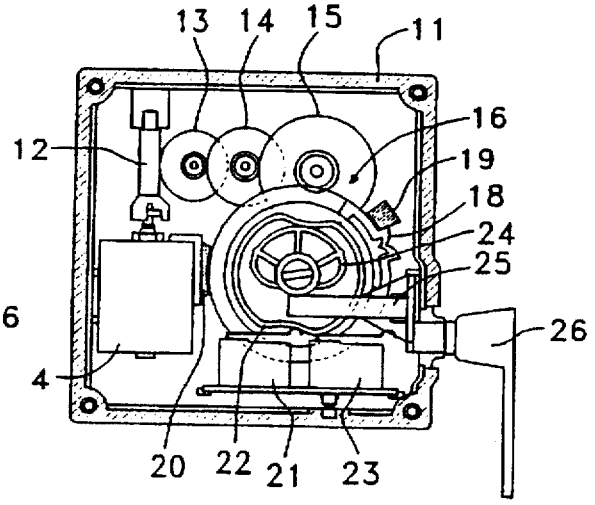
Fig. 3D (PRIOR ART)
Figure 4:
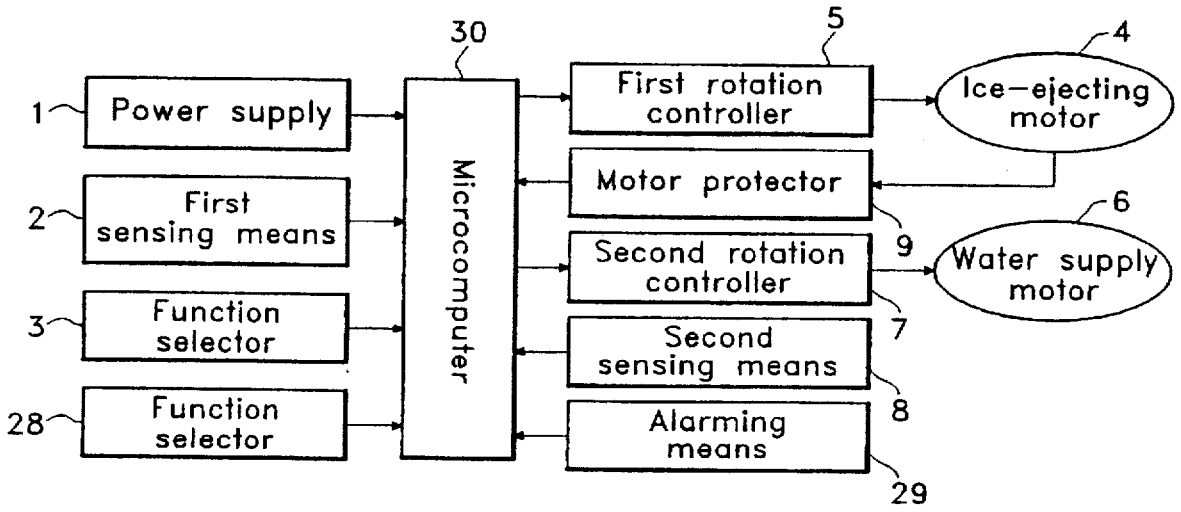
FIG. 4 is a schematic block diagram of an ice maker according to the invention.

Referring to FIG. 4, the invention includes: a first sensing means 2 for sensing the position of the tray, which sensing means is composed of the horizontal switch 21 and the level switch 23; a timer 28 for counting time and outputting time information; an alarming means 29 for indicating the occurrence of trouble in the ice maker; and a microcomputer 30 in which reference times according to the states of the horizontal switch and the level switch are predesignated, for controlling all the other components of the ice maker by comparing the time information with the predesignated reference time. The sensor 2, timer 28, alarm 29, and microcomputer would be associated with an ice maker of the type depicted FIGS. 3A–3D.

Figure 5:
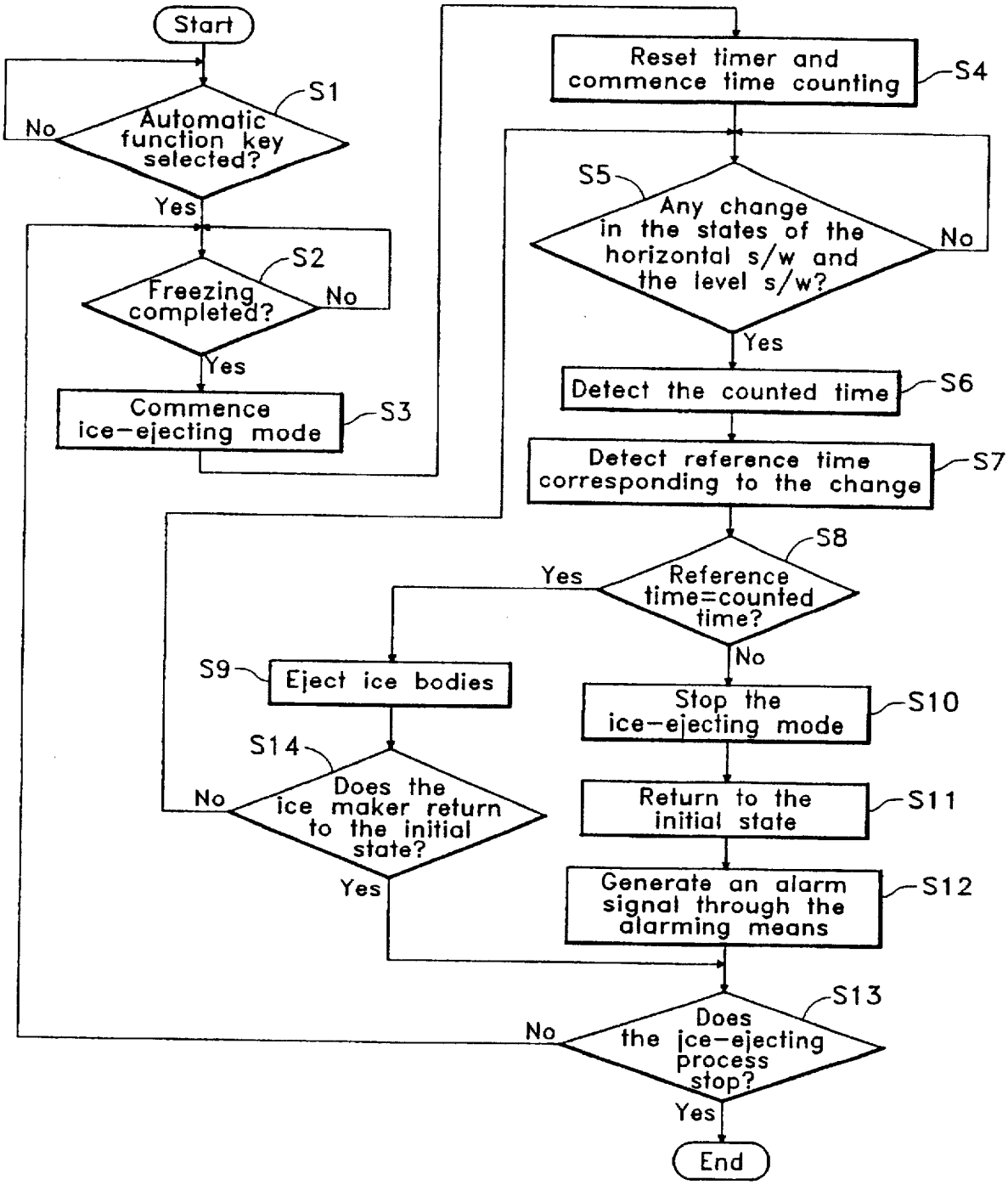
FIG. 5 is a flow chart for explaining the operation of the microcomputer of FIG. 4.

Referring to FIG. 5, the operation of the invention will be described.

Starting at step S1, the microcomputer 30 determines whether or not an automatic ice making function was selected. If the determination is negative, then the microcomputer 30 repeats step S1 until an automatic ice making function is selected.

Otherwise, if the answer is positive at the determination at step S1, then the microcomputer 30 drives the water supply motor 6 by transmitting a control signal to the second rotation controller 7 so that a preselected amount of water is provided from the water source to the tray 17.

At step S2, a determination is made as to whether or not the water in the tray 17 has been completely frozen. If the determination is negative, then the microcomputer 30 repeats step S2 until it receives a positive answer to the determination.

Otherwise, if the determination is positive at step S2, then the microcomputer 30 controls the first rotation controller 5 to set the ice maker in ice-ejecting mode at step S3 and simultaneously resets the timer 28 to commence time counting at step S4.

Then at step S5, a determination is made as to whether or not the states of the horizontal switch 21 and the level switch 23 have changed. If the determination is negative, this shows the ice maker is still in the same condition. In other words there is no change in state of the ice maker, e.g. from the initial state to the ice-ejecting preparation state, or from the ice-ejecting preparation state to the ice-ejecting state and vice-versa. At this time, the microcomputer 30 repeats step S5 until a state change occurs in the two switches 21 and 23.

Otherwise, if the answer is positive at the determination at step S5, this shows that the state of the ice maker is changed to another state. Then, the microcomputer 30 detects the time counted by the timer 28 at step S6, and simultaneously detects reference time information pertinent to a change in the state of the switches 21 and 23 at step S7. Table 1 shows the reference times.

Table 1 shows the reference times:

TABLE 1

| Rotation of Ice-ejecting motor | Horizontal switch | Level switch | Time (sec) | State of ice-ejecting mode |
|---|---|---|---|---|
| Start | Off | Off | 0 | Initial state (inactive) |
| Clockwise | On | Off | 1.2 | Initial ice-ejecting preparation state |
| | On | On | 2.6 | Final ice-ejecting preparation state |
| | Off | On | 8.0 | Ice-ejecting state |
| Stop | | | 1 sec wait | |
| Counter-clockwise | On | On | 1.2 | Return preparation state |
| | On | Off | 6.8 | |
| Stop | Off | Off | 8.0 | Initial state |

Steps S6 and S7 are followed by step S8 in which the microcomputer 30 compares the counted time obtained at step S6 with the reference time obtained at step S7. If the counted time corresponds to the reference time, it shows that the ice maker is operating normally. Then at step 9, the microcomputer allows the ice maker to proceed with an ice ejecting job.

If the answer is negative to the determination of step 8, i.e. the counted time is different from the reference time, this represents that the ice maker is abnormally operating, i.e. that the weight of the ice bodies in the tray 17 exceeds reference weight so that the tray cannot rotate at normal speed. At step 10, the microcomputer 30 suspends the ice-ejecting mode. Thereafter, the microcomputer 30 controls the first rotation controller 5 to rotate the motor 4 in the counter-direction (counter-clockwise direction) and accordingly return the tray 17 to the initial state at step S11. At step S12, the microcomputer 30 generates an alarm signal via alarming means 19 to indicate that the process is suspended. A determination is made at step S13 as to whether the ice-ejecting process has completely stopped. If the determination is positive, the process then terminates. Otherwise, if the determination is negative, then the process returns to step S2 and continues until the ice making process is finally completed.

After step S9 for performing ice-ejecting job, the microcomputer 30 determines whether or not the ice maker has returned to the initial state at S14. If the determination is negative, this means that the ice-ejecting operation continues. The process returns to step S5 and is repeated from step S5 until the ice making process is finally completed. Otherwise, if the determination is positive at step 14, this means that the ice-ejecting operation has been completed. Thus, step 14 is followed by step S13 for making a determination as to whether the ice-ejecting process has completely stopped. Then the process continues according to the determination of step S13.

As described above, this invention includes step S12 for generating an alarm signal. Accordingly, a user is able to easily recognize that the ice-ejecting operation is not being normally performed and, that the ice maker operation has stopped.

The reference time illustrated in Table 1 may be modified and a time range for permissible error may be designated for each reference time.

The alarming means 29 may be a visible or audible device.

A method for controlling the ice-ejecting mode of an ice maker according to the invention has the following effects.

(1) In the event that the tray rotates at a lower speed than the reference speed due to oversupplied water, the invention causes the ice maker to discontinue its normal operation by stopping the motor and returning the ice maker to the initial state.

(2) In the event the ice maker stops its work due to oversupplied water, the invention allows a user to easily recognize it due to the alarming means. This protects the user from mistakenly thinking that the cause of the error is a mechanical trouble in the ice maker.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A method of controlling an ice making mechanism which includes a tray for receiving water to be frozen into ice bodies, a sensor for determining whether the water is frozen and to initiate an ice-ejecting mode, a motor for rotating the tray to perform the ice-ejecting mode, a switching mechanism for indicating a state of the ice-ejecting mode, and a switch-actuating structure driven by the motor for changing a state of the switching mechanism during the ice-ejecting mode, the method comprising the steps of:

A) initiating an ice ejecting mode;

B) counting a time period beginning from step A;

C) determining whether the state of the switching mechanism has been changed;

D) stopping the ice-ejecting mode when a state of the switching mechanism has not changed within a reference time period; and E) generating an alarm signal indicating to a user that the ice-ejecting mode has been stopped.

2. The method according to claim 1 wherein step D further includes returning the tray to an initial state at which the tray was positioned prior to step A.

3. The method according to claim 1 wherein step E comprises generating a visible alarm signal.

4. The method according to claim 1 wherein step E comprises generating an audible alarm signal.

5. The method according to claim 1 wherein step D comprises sensing a change of state of the switching mechanism, determining the time period when such a change of state occurs, and comparing the time period with a reference time period.

6. The method according to claim 5 wherein the switching mechanism comprises first and second separately actuable switches, step C comprising determining a first time period beginning from step A, when both switches are changed from an off-state of an inactive condition to an on-state of a final ice-ejecting preparation condition and comparing the first time period with a first reference time period.

7. The method according to claim 6 wherein step C further comprises determining a second time period beginning from step A, when the first switch is changed from the on-state of the final ice-ejecting preparation condition to an off-state of an ice-ejecting condition, and comparing the second time period with a second reference time period.

8. The method according to claim 7 wherein step C further comprises determining a third time period beginning from step A, when the first switch is changed from the off state of the inactive condition to an on state of an initial ice-ejecting preparation state with the second switch still in an off-state, and comparing the third time period with a third reference time period.

9. The method according to claim 7 wherein the ice-ejecting mode is performed to completion in response to the second time period corresponding the second reference time period.

* * * * *